US011783689B2

(12) United States Patent
Madden

(10) Patent No.: US 11,783,689 B2
(45) Date of Patent: Oct. 10, 2023

(54) INTELLIGENT SEATING FOR WELLNESS MONITORING

(71) Applicant: ObjectVideo Labs, LLC, Tysons, VA (US)

(72) Inventor: Donald Gerard Madden, Columbia, MD (US)

(73) Assignee: ObjectVideo Labs, LLC, Tysons, VA (US)

( * ) Notice: Subject to any disclaimer, the term of this patent is extended or adjusted under 35 U.S.C. 154(b) by 0 days.

(21) Appl. No.: 17/694,119

(22) Filed: Mar. 14, 2022

(65) Prior Publication Data

US 2022/0198900 A1 Jun. 23, 2022

Related U.S. Application Data

(63) Continuation of application No. 16/925,683, filed on Jul. 10, 2020, now Pat. No. 11,276,289.

(60) Provisional application No. 62/872,486, filed on Jul. 10, 2019.

(51) Int. Cl.
*G08B 21/02* (2006.01)
*G08B 21/18* (2006.01)

(52) U.S. Cl.
CPC ..... *G08B 21/02* (2013.01); *G08B 21/182* (2013.01)

(58) Field of Classification Search
CPC ..... G08B 21/02; G08B 21/182
See application file for complete search history.

(56) References Cited

U.S. PATENT DOCUMENTS

| | | | |
|---|---|---|---|
| 7,304,580 | B2 | 12/2007 | Sullivan et al. |
| 8,275,514 | B2 | 8/2012 | Hwang et al. |
| 9,428,082 | B2 | 7/2016 | Hotary et al. |
| 9,795,322 | B1 | 10/2017 | Karunaratne et al. |
| 10,325,472 | B1 | 6/2019 | Harsdorff et al. |
| 2010/0052381 | A1 | 3/2010 | Tingley et al. |
| 2011/0055720 | A1 | 3/2011 | Potter et al. |
| 2011/0275939 | A1 | 11/2011 | Walsh et al. |
| 2012/0286954 | A1 | 11/2012 | Cullen |

(Continued)

FOREIGN PATENT DOCUMENTS

| | | | |
|---|---|---|---|
| CN | 203776458 | U | 8/2014 |
| CN | 204995014 | U | 1/2016 |

(Continued)

*Primary Examiner* — Hongmin Fan
(74) *Attorney, Agent, or Firm* — Fish & Richardson P.C.

(57) ABSTRACT

Methods, systems, and apparatus, including computer programs encoded on a computer storage medium, are described for implementing intelligent seating for wellness monitoring. A system obtains data from a first sensor integrated in an intelligent seating apparatus at a property. The first data indicates a potential abnormal condition of a person at the property. The system determines that the person has an abnormal condition based on the first data corresponding to the person having used the seating apparatus. Based on the abnormal condition, the system provides an indication to a client device of the person to prompt the person to adjust their use of the seating apparatus. The system also obtains visual indications of the abnormal condition, determines the type of abnormal condition afflicting the person, and determines a wellness command with instructions for alleviating the abnormal condition. The wellness command is provided for display on the client device.

20 Claims, 3 Drawing Sheets

(56) References Cited

U.S. PATENT DOCUMENTS

| | | | |
|---|---|---|---|
| 2016/0213140 | A1 | 7/2016 | Koch |
| 2017/0092094 | A1 | 3/2017 | Yang et al. |
| 2018/0251031 | A1 | 9/2018 | Liebau et al. |
| 2019/0175076 | A1 | 6/2019 | Lustig et al. |
| 2019/0318602 | A1 | 10/2019 | Nevin |
| 2020/0394556 | A1 | 12/2020 | Boss et al. |

FOREIGN PATENT DOCUMENTS

| | | | | |
|---|---|---|---|---|
| CN | 209360118 | * | 10/2018 | ..... A47C 7/40 |
| CN | 108814616 A | | 11/2018 | |
| DE | 102013109830 | * | 9/2013 | ..... A47B 21/02 |
| WO | WO 2010023414 | * | 8/2009 | ..... G09B 19/003 |

* cited by examiner

INTELLIGENT SEATING FOR WELLNESS MONITORING

CROSS REFERENCE TO RELATED APPLICATION

This application is a continuation of U.S. patent application Ser. No. 16/925,683, filed Jul. 10, 2020, which claims the benefit of U.S. Patent Application Ser. No. 62/872,486, filed on Jul. 10, 2019. The complete disclosures of all of the above patent applications are hereby incorporated by reference in their entirety.

FIELD

This specification relates to devices for monitoring and controlling items at a property.

BACKGROUND

Monitoring devices are often dispersed at various locations at a property such as a home or commercial business. The devices can have distinct functions at different locations of the property. Some devices at a property offer data analysis, monitoring, and control functionality that can be leveraged to assess the overall wellness of an individual located at the property.

SUMMARY

The ability of a person to sit down and get up from a chair is an important metric in occupational therapy assessments, and a good indicator of the overall mobility and wellness of an individual as they age or recover from injury. Simply measuring the time it takes to sit down or stand up can be used as a benchmark for fitness, but expert analysis can assess the strength and mobility of the legs, hips, and back as well as overall cardiovascular health. Assessment of sitting and rising from a chair can help predict falls, which are quite common in elderly persons during this activity. A person's posture and balance while they sit can also be an important factor in diagnosing similar issues, as well as a cause of physiological issues, such as lower back pain and other types of physical discomfort.

This document describes methods, systems, and apparatus, including computer programs encoded on a computer storage medium, for obtaining and analyzing sensor data to determine wellness attributes of a person, including one or more conditions associated with overall fitness or wellness of a person. A computing system that includes various types of sensors obtains a first set of sensor data from a first type of sensor integrated in a seating apparatus at a property. The first set of sensor data can indicate a potential abnormal condition that is associated with overall wellness of a person at the property. The system determines that the person at the property has an abnormal condition using the first set of sensor data obtained from the first type of sensor. In some cases, the first type of sensor can be a weight sensor or pressure sensor that is located along a hand rest, support legs, or seat portion of an example seating apparatus, such as a chair.

The system makes the determination based at least on the person having used the seating apparatus at the property. The system provides an indication to a client device of the person, for display at the client device, to prompt the person to adjust how the person uses the seating apparatus. For example, the indication can include instructions that prompt the person to shift their position while sitting in a chair or to stand up rather than remain seated in the chair. The system obtains a second set of sensor data from the first type of sensor, a type of second sensor integrated in a recording device at the property, or both. In some cases, the second set of sensor data provides a visual indication of the abnormal condition. For example, the abnormal condition can be that the user is slouching in the seating apparatus or is seated in a position that is likely to cause long-term physical discomfort.

The system is operable to determine that the abnormal condition is a particular type of abnormal condition, such as poor posture or lower back pain. The system is operable to determine a wellness command that includes or triggers instructions for alleviating the particular type of abnormal condition afflicting the person. The system can then provide the wellness command to trigger a display or output of instructions to alleviate the particular type of abnormal condition when a user or device performs at least a portion of the instructions included in or triggered by the command.

Other implementations of this and other aspects include corresponding systems, apparatus, and computer programs, configured to perform the actions of the methods, encoded on computer storage devices. A computing system of one or more computers or hardware circuits can be so configured by virtue of software, firmware, hardware, or a combination of them installed on the system that in operation cause the system to perform the actions. One or more computer programs can be so configured by virtue of having instructions that, when executed by data processing apparatus, cause the apparatus to perform the actions.

The subject matter described in this specification can be implemented in particular embodiments so as to realize one or more of the following advantages. The techniques described in this document can be used to enhance monitoring and analysis capabilities of a property monitoring system to determine abnormal conditions afflicting users at the property. For example, the described techniques can be applied to analyze sensor data that is generated each time a user/person sits or stands in a seating apparatus at the property.

The techniques can provide several advantages such as: 1) enabling real-time diagnosis and feedback of medical issues; 2) improved wellness assessment of a person in a natural environment relative to other property monitoring system; 3) enabling short-term and long-term wellness or fitness trend analysis; 4) correlation with other data/sensor data obtained in a home or property; and 5) reductions in current costs, risks, and hassles associated with in-home or out-patient therapy visits.

The details of one or more implementations of the subject matter described in this specification are set forth in the accompanying drawings and the description below. Other potential features, aspects, and advantages of the subject matter will become apparent from the description, the drawings, and the claims.

BRIEF DESCRIPTION OF THE DRAWINGS

Like reference numbers and designations in the various drawings indicate like elements.

DETAILED DESCRIPTION

A property, such as a house or a place of business, can be equipped with a monitoring system to enhance the security of the property. The property monitoring system may include one or more sensors, such as weight sensors, pressure sensors, cameras, or temperature sensors distributed about the property to monitor conditions at the property. In many cases, the property monitoring system also includes one or more controls, which enable automation of various property actions, such as generating a command, instructions, or indications for output (e.g., display) at a client device, locking/unlocking a door at the property, adjusting lighting conditions at the property, or detecting motion at the property. In some cases, the command is operable to trigger the indications and instructions at the client device. The property monitoring system can also include a control unit and a recording device (e.g., a digital camera/video recorder) that are each configured to provide information to a monitoring server of the system. The monitoring server can use the information to determine conditions at the property.

In this context, techniques are described for analyzing and monitoring wellness attributes of an individual using intelligent seating apparatus located at a property. The seating apparatus can include chairs and other seating surfaces that are instrumented with sensors that are operable to assess sitting and standing of a person. The data generated by the sensors can be sampled to measure wellness dynamics of how a person sits on or gets into a chair from a standing position as well as how the person stands back up out of the chair from a seated position. The sensors are also operable to provide personal fitness metrics, such as a person's heart rate or body temperature. The sensors at the seating apparatus integrate with a property monitoring system of a home or commercial property. The property monitoring system interacts with the sensors of the seating apparatus to correlate and analyze generated sensor data with other wellness information received for the person.

Figure 1:
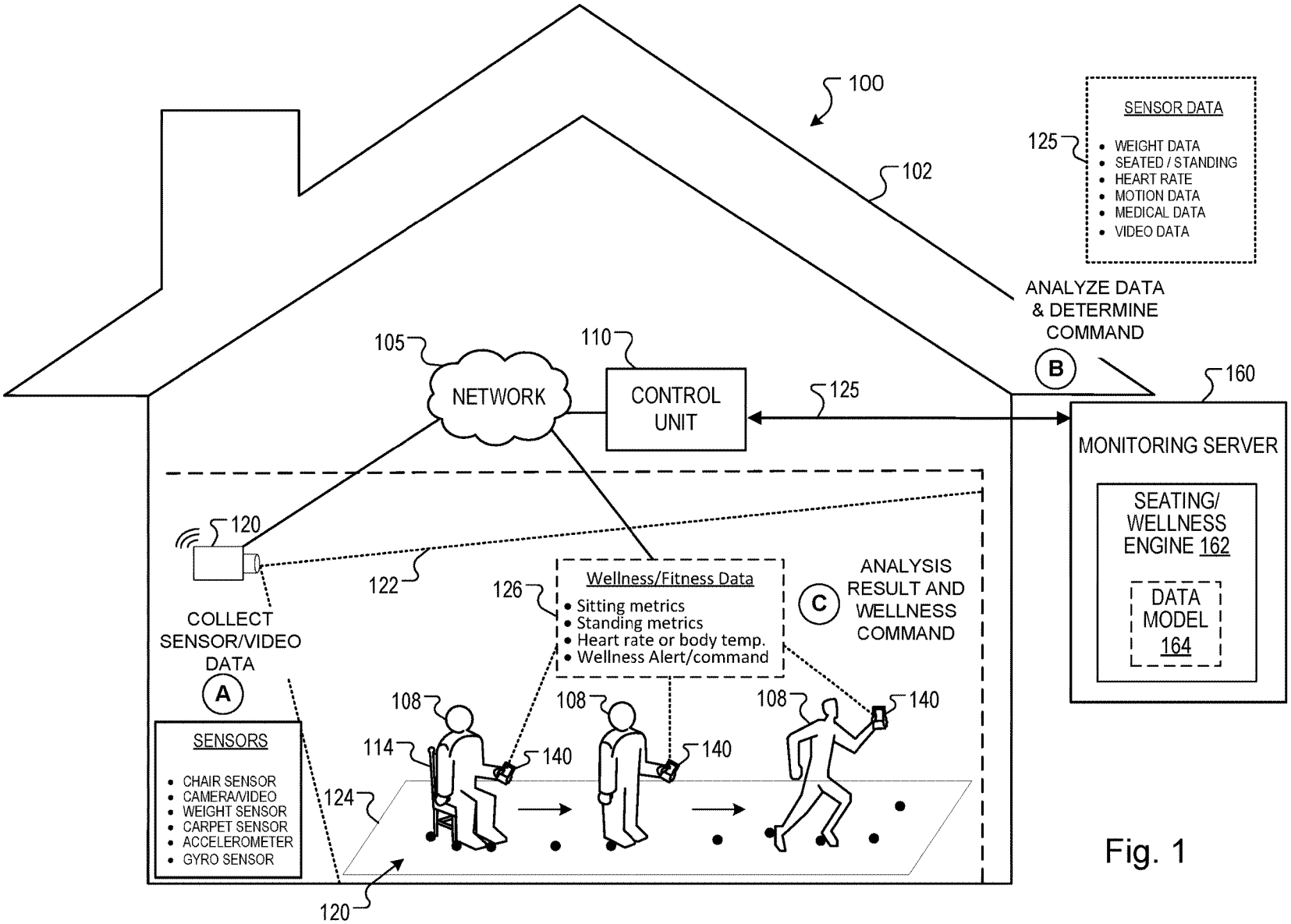
FIG. 1 shows a block diagram of an example system for collecting and analyzing wellness data using intelligent seating at a property.

FIG. 1 shows a block diagram of an example computing system 100 for analyzing and monitoring wellness attributes of an individual using intelligent seating apparatus located at a property 102. The system 100 can include sensors 120 that are installed in a video recording device, a smart carpet/flooring 124, and multiple other devices that are located at a property 102 monitored by a property monitoring system. The property 102 may be, for example, a residence, such as a single family home, a townhouse, a condominium, or an apartment. In some examples, the property 102 may be a commercial property, a place of business, or a public property.

The system 100 can include multiple sensors 120. Each sensor 120 can be associated with various types of devices that are located at property 102. For example, an image sensor 120 can be associated with a video or image recording device located at the property 102, such as a digital camera or other electronic recording device. Similarly, a sensor(s) can be associated with intelligent seating devices, including mechanisms and apparatus for obtaining, analyzing, and monitoring wellness attributes of an individual. As described above, the property 102 is monitored by a property monitoring system. The property monitoring system includes a control unit 110 that sends sensor data 125 obtained using sensors 120 to a remote monitoring server 160. In some implementations, the property monitoring systems and monitoring servers 160 described herein are sub-systems of system 100.

The control unit 110 at the property 102 is operable to send video data 125 obtained using sensors 120 (e.g., installed in a video recorder) to a remote monitoring server 160. The control unit 110 is described in more detail below. In some implementations, a recording device can be a particular type of sensor 120 or may be a combination of different types of sensors 120. Video recorder can be an electronic device configured to obtain video or image data of various rooms and sections of property 102. For example, the video recorder can be a camera (e.g., a digital camera) that captures video or still images within a viewable area 122 of the property 102.

Monitoring server 160 includes an intelligent seating and wellness engine 162 (described below) that is operable to process sensor data obtained from the sensors at the property to determine conditions associated with an overall wellness or fitness of a person at the property. In some implementations, the sensor data is obtained using certain types of sensors that are integrated in different sections of an intelligent seating apparatus 114 (described below) included at the property 102. For example, the wellness engine 162 correlates and analyzes the generated sensor data with other wellness information received for the person to determine the conditions.

The monitoring server 160 is configured to pull or obtain new sensor data 125 from one or more sensors 120 and to use the seating and wellness engine 162 ("wellness engine 162") to analyze the new data. In response to analyzing the new data using the wellness engine 162, the monitoring server 160 can detect or determine that an abnormal condition may be affecting a person at the property 102. The monitoring server 160 receives and analyzes the video data, user position data, and various other sensor data 125 encoded in wireless signals transmitted by sensors 120. The monitoring server 160 performs various functions for analyzing and monitoring conditions and wellness attributes of a person in the viewable area 122 at the property 102 based on the video data and other sensor data encoded in the wireless signal.

Control unit 110 can be located at the property 102 and may be a computer system or other electronic device configured to communicate with the sensors 120 to cause various functions to be performed for the property monitoring system or system 100. The control unit 110 may include a processor, a chipset, a memory system, or other computing hardware. In some cases, the control unit 110 may include application-specific hardware, such as a field-programmable gate array (FPGA), an application-specific integrated circuit (ASIC), or other embedded or dedicated hardware. The control unit 110 may also include software, which configures the unit to perform the functions described in this document.

In some implementations, a user 108 communicates with the control unit 110 through a network connection, such as a wired or wireless connection. As indicated above, the user can be a property owner, security manager, property manager, or occupant/resident of the property 102. In some implementations, the property owner or user 108 communicates with the control unit 110 through a software ("smart home") application installed on their mobile/client device 140. The control unit 110 can perform various operations related to the property 102 by sending commands to one or more of the sensors 120 at the property 102.

For example, the control unit 110 can activate a camera 121, lock or unlock a door/window, activate/arm an alarm system, de-activate/de-arm the alarm system, power on or off a light at the property 102. The control unit 110 can be also used to provide commands and indications that include (or trigger) instructions for improving the overall wellness of a person or for alleviating a particular type of abnormal condition that may be afflicting the person. As described in more detail below, the user 108 can use client device 140 to interact with the smart home application and provide commands to the sensors 120, via the control unit 110, to perform the various operations described in this document. The control unit 110 can also communicate with one or more home automation controls of the property 102 to control the operation of home automation devices at the property. For example, control unit 110 can manage operation of door locks and interior or exterior lights.

The sensors 120 can receive, via network 105, a wireless (or wired) signal that controls operation of each sensor 120. For example, the signal can cause the sensors 120 to initialize or activate to sense activity at the property 102 and generate sensor data 125. The sensors 120 can receive the signal from monitoring server 160 or from control unit 110 that communicates with monitoring server 160, or from the wellness engine 162 accessible by the monitoring server 160. In addition to detecting and processing wireless signals received via network 105, the sensors 120 can also transmit wireless signals that encode sensor data 125 describing an orientation, seating position or movement of a person or seating apparatus 114 at the property 102.

The sensors 120 and video recorder 121 communicate with the control unit 110, for example, through a network 105. The network 105 may be any communication infrastructure that supports the electronic exchange of sensor data 125 between the control unit 110, the video recorder 121, and the sensors 120. The network 105 may include a local area network (LAN), a wide area network (WAN), the Internet, or other network topology.

The video recorder 121 sends various sensor/video data 125 to the control unit 110. For example, the video recorder 121 can send image or video data 125 from one or more camera sensors, motion sensing data 125 from one or more motion detectors, or other sensor or video data 125 related to a location of a person 108 at the property, user contact or interaction with seating apparatus 114, or general information about other items at the property 102. The video data 125 transmitted by the video recorder 121 can be encoded in radio signals transmitted by the sensing components 120 of the video recorder 121.

The seating apparatus 114 can be an intelligent seating apparatus that is equipped with a number of sensors 120. In some implementations, the intelligent seating apparatus 114 includes transceivers for enabling a data connection to the property monitoring system and onboard processing for interpretation of sensor data 125, including sensor data 125 that is generated locally by sensors 120 integrated in the seating apparatus 114. The seating apparatus 114 can include various types of sensors 120 that are each placed or disposed at different sections of the seating apparatus 114, such as a leg, an arm rest, or seat cushion of the seating apparatus 114.

For example, the seating apparatus 114 can be a chair (or stool), sofa, or bench that includes force or pressure sensors at each leg or contact point with a floor area 124 at the property. Such sensors are operable to measure the force applied at each leg of a seating apparatus 114 that contacts the floor area 124 when a user is seated in a chair. The seating apparatus 114 can also include pressure and/or deformation sensors in an example seat cushion, back support, or arms of the chair to measure pressure or deformation at these support features of the seating apparatus 114.

In some implementations, the seating apparatus 114 is an articulated recliner that includes one or more sensors 120 that are operable to determine a configuration of the articulated recliner. The seating apparatus 114 can also include strain sensors that are operable to measure lateral forces on the legs or back of the seating apparatus 114. The seating apparatus 114 can also include sensors 120 that are accelerometers or gyroscopes to sense movement or change in position of the seating apparatus 114, such as sliding, spinning, or rocking of the seating apparatus 114. In some implementations, the seating apparatus 114 includes capacitive sensors 120 that are operable to detect contact points along the seating apparatus (e.g., a chair).

The system 100 can optionally include video or other non-contact sensors 120 that are operable generate sensor data 125 for determining body pose throughout an example process of a user entering and exiting the chair 114. The system 100 can also optionally include sensors 120 such as audio sensors, infrared (IR) sensors, and sensors associated with wearable devices for obtaining information relating to a fitness, wellness, or medical status of a person. For example, these types of sensors can provide sensor data 125 describing respiration details, heart rate, or blood pressure of a person and for analysis at the wellness engine 162 or monitoring server 160. In some implementations, these types of sensors can optionally provide sensor data 125 that describes health information about a person, such as age, weight, or height of the person.

In some implementations, at least a subset of sensors 120 at the property 102 could be built into a chair representing seating apparatus 114 when the chair is manufactured, or the sensors 120 could be retrofitted to an existing seating apparatus 114. For example, retrofitting the sensors 120 to seating apparatus 114 can include: integrating a sensor in pads, casters, cups, or glides that affix to a bottom of each chair leg of the seating apparatus 114. In some examples, the sensors 120 can be retrofitted to strips, pads, or mats that cover a surface of the contact points between seating apparatus 114 and smart flooring 124. In some implementations, one or more sensors 120 can be retrofitted to add-on or replacement cushions or arm rest covers installed at the seating apparatus 114 as well as to sensor pads affixed to existing sections of the seating apparatus 114.

The system 100 includes a smart flooring 124. In some implementations, the smart flooring 124 is flooring at the property 102 that includes one or more distinct types of sensors 120. For example, the various types of sensors 120 can be integrated into certain sections or layers of the flooring 124. The smart flooring 124 is operable to communicate with devices of the property monitoring system to provide sensor data 125 obtained from sensors 120 included in the flooring 124. An example smart flooring 124 that includes the integrated sensors 120 is operable to sense pressure or force applied to the flooring, user contact with the flooring, user weight or weight distribution, or a combination of each. In some implementations, the flooring 124 is a mat, rug, or carpet that covers a floor space under the seating apparatus 114, such as a space where a user might stand before and after sitting in the seating apparatus 114.

In some examples, various types of sensors 120 can be distributed throughout the property 102 as extended or peripheral sensing instrumentation. For example, some sensors 120 can provide sensing functions that extend to a paired footstool or other furniture that might bear weight during a process of a person sitting down in a chair that represents seating apparatus 114, sitting in the chair, or standing up from getting out of the chair. For example, if the person uses a cane, walker, crutches, or other device for assisted walking, some sensors 120 could be instrumented at the property 102 to return parameter values for pressure/force readings describing applied pressure when a person uses a device for assisted walking. In some implementations, the extended or peripheral sensing instrumentation applies to various items or seats, such as chairs, couches, benches, beds, toilets, etc.

Wellness engine 162 can include a data model 164 that is generated based on sensor data 125. In some implementations, the data model 164 is accessed and used by the monitoring server 160 to detect or determine that an abnormal condition is a particular type of abnormal condition afflicting the person at the property. The data model 164 is also used to determine a wellness command that includes or triggers instructions for alleviating the particular type of abnormal condition afflicting the person. The system 100 uses the wellness command to trigger display of the instructions at the client device for alleviating the particular type of abnormal condition based on analysis of the received sensor/video data 125, where the analysis is performed using the data model 164.

The wellness engine 162 can also use computing logic for various image, video, and data analytics to build the data model 164. In some implementations, the wellness engine 162 includes machine learning logic for processing inputs obtained from sensor data 125. The input data is processed to generate a machine-learning model that corresponds to a trained data model 164. For example, the data model 164 can be a neural network or support vector machine that is trained to compute inferences or predictions about abnormal conditions that are associated with how a person interacts with a seating apparatus.

Based on learned observations from computations performed by the trained data model 164, the system can determine, and provide, a wellness command that triggers an output of instructions for alleviating a particular type of abnormal condition afflicting a person. For example, the wellness engine 162 can generate a command that instructs the person to reposition their body in the seating apparatus 114 or to perform a particular type of physical movement to relieve pressure on their lower back or legs. The command can be received at a client device to cause an output of video, audio, or both to instruct the person.

In addition to providing instructions to help alleviate an abnormal condition, the wellness engine 162 is operable to provide: a) feedback on how well a user is executing or adhering to a set of instructions and b) an indicator of progress towards alleviating the abnormal condition or the particular type of abnormal condition. The wellness engine 162 can provide the feedback based on one or more of sensors integrated in the chair or seating apparatus (e.g., chair sensors) and image/video data of the user performing an action indicated by the instruction.

In some implementations, the data model 164 is trained to generate predictions indicating a particular type of abnormal condition that is affecting a person based on sensor information about how a person sits in a chair, gets up from sitting in a chair, or how the person is positioned while sitting in the chair. Hence, the data model 164 can be trained to determine whether a person that was, or is, located at property 102 has an abnormal condition. The determination can be made in response to an example trained data model 164 processing data inputs (e.g., images or video) obtained from one or more of the different types of sensors 120 located at the property 102. In some implementations, the data model 164 is iteratively updated over multiple observations. For example, the data model 164 can be updated each time a person adjusts their position relative to the seating apparatus 114, interacts with seating apparatus 114, or causes sensors 120 to obtain sensor data 125.

The system 100 is configured to establish a baseline for a given individual, for example, through multiple observations over time using a trained version of the data model 164. The established baseline may be stored at the monitoring server 160 or the wellness engine 162 as a baseline wellness profile of a user/individual. The wellness engine 162 can be used to detect an abnormal condition, in part or in whole, based on data values that indicate a deviation from one or more parameters of the user's baseline. The deviation can either suddenly or gradually. In some implementations, the data model 164 is configured to detect a deviation from an expected parameter value indicated in the baseline wellness profile and then determine that the person has an abnormal condition based on the detected deviation.

For a given abnormal condition, the system 100 is configured to determine, compute, or otherwise grade the severity of the abnormal condition. For example, the can system 100 determine (or compute) a score that represents a grade of the severity of the abnormal condition. The severity may be measured based on overall impact to a user's overall health or mobility. The computed grade can be based on a single score or multiple scores representing different conditions or different metrics of the same condition. For example, the grade of severity of a hamstring injury can be based on metrics or conditions such as a user's speed of getting out of the chair/apparatus 114 or the user's stability while getting out of the chair.

As described below, in some examples the wellness engine 162 is configured to determine a remediation and a corresponding set of instructions for the user to reduce the severity of the particular type of abnormal condition. The wellness engine 162 can make this determination based on the grade of severity computed for the user. The monitoring server 160 can provide the set of instructions corresponding to the remediation for display at the client device.

In some implementations, the observed speed generates a score of 0.3, whereas the observed stability generates a score of 0.6. In some other implementations, the wellness engine 162 or data model 164 generates a single composite score for grading the severity of the abnormal condition (e.g., hamstring injury) and the observed speed receives a 30% weighting for the composite score, whereas the observed stability receives a 60% weighting for the composite score. The scores and severity grades can be derived in a number of ways. For example, the wellness engine 162 is operable to compare a measured value from the chair sensor or video data against model parameters that are based on an individual's height, weight, and age, or by learning dynamically learning different baselines for the individual and using one or more of the different baselines as a "normal" (or "reference") to detect future declines or improvements.

The wellness engine 162 determines whether a given score or grade is above or below a particular threshold and then determines whether a user is subject to remediation based on the threshold calculation. For example, the data model 164 can trigger assigning different instructions or types of exercises to a user based on a particular speed score, stability score, or overall grade of severity of the abnormal condition being above or below a predefined or dynamic threshold. In some implementations, as a given grade or score increases or decreases, the system 100 is operable to provide feedback to the user with respect their progress toward alleviating the abnormal condition or reducing severity of the abnormal condition. The wellness engine 162 can adjust, modify, or change assigned exercises based on a current score(s) or grade of severity computed for a user.

In some cases, the dynamically learned baselines described above are used to set the thresholds for triggering remediation and other types of feedback to a user. The system 100 can also be used by a person without abnormal conditions to maintain and monitor fitness levels of the user. For example, the wellness engine 162 is configured to maintain and monitor fitness levels of the user using some of the same or similar instructions that are provided to alleviate an existing abnormal condition and feedback processes described above. In some implementations, the data model 164 is used to maintain or develop good habits and conditioning of a user that previously alleviated an abnormal condition based on prior instructions provided by the data model 164.

FIG. 1 includes stages A through C, which represent a flow of data.

In stage (A), each of the one or more sensors 120 generate sensor data 125 including parameter values that describe different types of sensed activity at the property 102. In some implementations, the control unit 110 (e.g., located at the property 102) collects and sends the sensor data 125 to the remote monitoring server 160 for processing and analysis at the monitoring server.

The sensor data 125 can include parameter values that indicate a weight of a person, a weight distribution when the person is sitting or shifting in the seating apparatus 114, or a heart rate of the person. The sensor data 125 can also include parameter values that indicate sensed motion or force distribution when the person is sitting in a chair or standing up from being seated in a chair, medical conditions of the person, a body temperature of the person, or images/videos of the person.

In stage (B), the monitoring server 160 receives or obtains sensor data 125 from the control unit 110. As discussed above, the monitoring server 160 can communicate electronically with the control unit 110 through a wireless network, such as a cellular telephony or data network, through any of various communication protocols (e.g., GSM, LTE, CDMA, 3G, 4G, 5G, 802.11 family, etc.). In some implementations, the monitoring server 160 receives or obtains sensor data 125 from the individual sensors rather than from control unit 110.

In stage (C), the monitoring server 160 analyzes the sensor signal data 125 and/or other property data received from the control unit 110 or directly from sensors/devices 120 located at the property 102. As indicated above, the monitoring server 160 analyzes the sensor data 125 to determine wellness attributes of a person, including one or more conditions associated with overall fitness or wellness of a person.

The wellness engine 162 is operable to analyze parameter values that reveal processes by which a person transfers their weight or contact forces during a transition from standing to sitting in the seating apparatus 114 as well as during the transition from sitting in the seating apparatus 114 to standing. In some implementations, the wellness engine 162 uses encoded instructions of the data model 164 to measure, infer, or otherwise predict the amount of force distribution and weight transfers at each contact point of the seating apparatus 114 for multiple of these processes that may occur over time.

The wellness engine 162 can generate a profile that describes how a person sits and stands overtime. The wellness engine 162 can also compare data values of the profile to predefined templates and parameters to yield a functional wellness assessment for the person. The profiles and wellness assessment can reveal one or more conditions that are afflicting the person. In some cases, the monitoring server 160 processes the sensor data 125 using the wellness engine 162 and determines that a person at the property 102 has an abnormal condition based on the data processing operations performed at the wellness engine 162.

The property monitoring system sends a command 126, e.g., a wellness command that includes instructions or information for prompting a person at the property 102 to perform an action. For example, the command 126 can trigger an output of instructions for alleviating a particular type of abnormal condition (e.g., sciatica or back pain) afflicting the person. The system can then provide the wellness command to alleviate the particular type of abnormal condition, for example, when a user or device performs at least a portion of the instructions included in the command.

In some implementations, activity sensed in a chair or seating apparatus 114 can be used as triggers for automation or automated actions at the property 102. For example, monitoring server 160 can detect when a user sits down in an easy chair at the property 102. In response to this detection, the monitoring server 160 is operable to transmit a control signal to a sensor 120 to turn on (or provide power to) a reading light that is adjacent the easy chair in a room at the property 102. Likewise, in response to detecting that a user sat in the seating apparatus 114, the monitoring server 160 can transmit commands to a sensor 120 to cause classical music to beginning playing, a TV to turn on, or a streaming application to begin playing on the TV.

In some implementations, the monitoring server 160 launches a particular automated function based on a recognized identity of an individual. The monitoring server 160 can recognize or determine an identity of an individual based on analysis of sensor data indicating certain weight and movement patterns that are specific to a particular user or video and image data that show the user's facial features.

Though the stages are described above in order of (A) through (C), it is to be understood that other sequencings are possible and disclosed by the present description. For example, in some implementations, the monitoring server 160 may receive sensor data 125 from the control unit 110. The sensor data 125 can include both sensor status information and usage data/parameter values that indicate or describe specific types of sensed activity for each sensor 120. In some cases, aspects of one or more stages may be omitted. For example, in some implementations, the monitoring server 160 may receive and/or analyze sensor data 125 that includes only usage information rather than both sensor status information and usage data.

Figure 2:
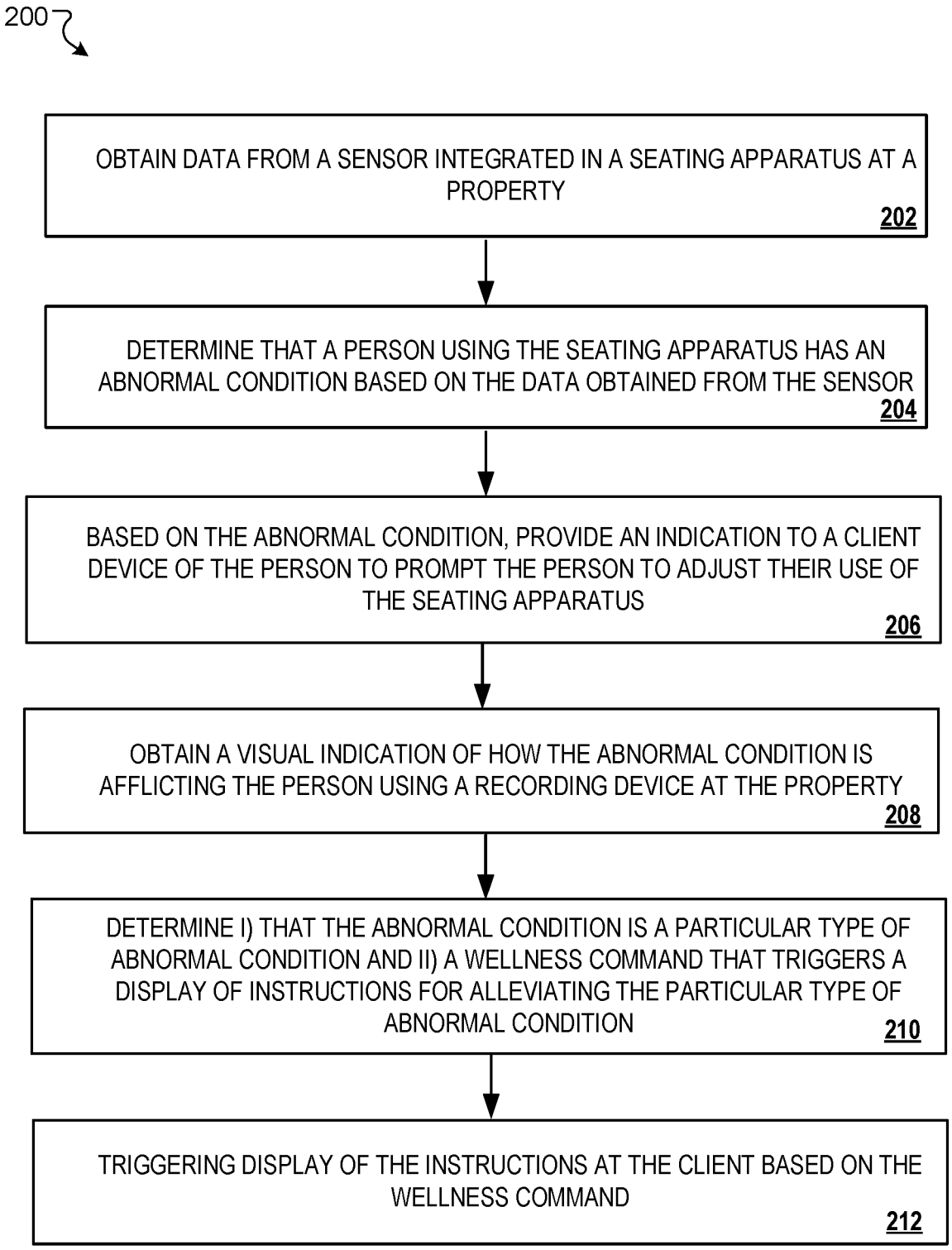
FIG. 2 shows an example process for collecting and analyzing wellness data using intelligent seating at a property.

FIG. 2 shows an example process 200 for collecting and analyzing wellness data using intelligent seating at a property 102. In general, process 200 can be implemented or performed using the systems described in this document. Descriptions of process 200 may reference one or more of the above-mentioned computing resources of systems 100 as well as resources of system 300 described in more detail below. In some implementations, steps of process 200 are enabled by programmed instructions executable by processing devices of the systems described in this document.

Referring now to process 200, system 100 obtains first data from a first sensor integrated in a seating apparatus at a property (202). The first data can indicate a potential abnormal condition associated with a person at the property. The first data is obtained using sensor signals that are transmitted or generated by the sensors 120. For example, the wellness engine 162 can process various sensor data 125 that indicate one or more wellness or fitness cues for an individual. The wellness and fitness cues can include an amount of time taken to sit or stand in seating apparatus 114, the fluidity of motion, or an amount of force applied to sensors 120 during the sitting action (e.g., does the user fall into the chair or gently sit in a chair).

In some implementations, wellness cues include symmetry of weight distribution and movements of a person sitting in seating apparatus 114, amount of weight placed on sensors integrated in armrests or on a connected assistive device such as a cane. In some implementations, items at the property 102 can be equipped with additional sensors 120 that are operable to provide sensor data 125 that indicates changes in heart rate, respiration, or other health metrics as a user stands or sits.

System 100 determines that the person has an abnormal condition using the first data obtained from the first sensor (204). The determination is based at least on the person having used the seating apparatus at the property. The determination is made using at least the wellness engine 162 and data model 164. In some implementations, the system 100 uses machine-learning techniques to develop one or more data models, such as data model 164. For example, the system 100 can generate a data model 164 that is trained on annotated data from a large group of individuals at the property 102. In some examples, the data model 164 is trained on a large group of individuals at various properties to generate a baseline model. This baseline version of the data model 164 can then be fine-tuned or adapted to have an analytical framework that is specific to a system installation, seating apparatus, and/or individual(s) at a particular property.

In some implementations, the data model 164 is operable to score inputs of sensor data 125 along various axes, such as fluidity, speed, or symmetry of motion. The scores computed from the inputs can be used or monitored to detect certain trends or inflections points in the sensor data. The data model 164 is operable to monitor changes in a user's motion over time to spot trends or inflection points that are indicative of an abnormal condition or other related wellness condition of a person.

System 100 provides an indication to a client device of the person, for display at the client device, to prompt the person to adjust how the person uses the seating apparatus at the property based at least on the determined abnormal condition (206). The indication can be generated by the wellness engine 162 based on sensor data analysis performed using a trained data model 164 of the wellness engine 162.

In some cases, the first data obtained from the sensors 120 integrated at a chair are used to determine that a person likely has an abnormal condition or to compute a probability that the person has an abnormal condition. In response to determining this likelihood or probability, the system 100 is operable to prompt the user to move or adjust their seating position. As described in more detail below, the system can obtain additional sensor data from other devices at the property to confirm that the person has the abnormal condition.

In some implementations, the system 100 causes the data model 164 to be trained based on example heuristic algorithms to detect and alert a user to one or more anomalous situations or wellness conditions in view of the analysis performed on the sensor data 125. For example, the data model 164 can be trained to detect: i) when a user falls from seating apparatus 114, ii) lack of movement at the seating apparatus 114, or iii) erratic or violent movements that are indicative of an abnormal condition or medical issue. In some implementations, the lack of movement at the seating apparatus 114 can range from detecting that a user has been sitting too long, that it is time for the user to stand up and stretch, that it is time for the user to wake up and go to bed, or that the property monitoring system should to alert emergency medical personnel.

System 100 obtains a visual indication of how the abnormal condition is afflicting the person at the property (208). The visual indication is obtained using a recording device at the property, such as a digital camera or imaging device. In some implementations, obtaining the visual indication includes obtaining second data from the first sensor integrated in the seating apparatus, a second sensor integrated in a recording device at the property, or both. The second data can provide visual information that indicates the abnormal condition is afflicting a neck area, lower back, or upper back of the person. For example, the visual information can reveal abnormal conditions associated with arm, chest, or leg pain based on how the person adjusts or repositions themselves relative to the seating apparatus after being prompted to adjust their use of the seating apparatus.

In some implementations, the second sensor is an image sensor 120 and second data is video analytics data obtained using a camera or video recorder that includes an image sensor. For example, a camera at the property 102 provides image or video data that shows the seating apparatus 114 as well as a user that is seated in the seating apparatus. Based on the image/video data, wellness engine 162 is operable to recognize the individual seated in the seating apparatus 114 (e.g., chair). The wellness engine 162 is also operable to recognize the individual seated in the chair by inferring identifying attributes of the individual in response to analyzing video data of the individual's stride or approach toward the seating apparatus.

The wellness engine 162 is operable to analyze a user's poses and physical actions to determine or infer wellness attributes of the user. In some implementations, the system 100 uses the data model 164 to fuse the image/video data (e.g., second data) with other sensor data 125 obtained from sensors 120 integrated in the chair to generate a wellness profile for the user. In some cases, the system 100 processes the image/video data (a first modality) in combination with the data from sensors integrated in the chair (a second modality) to accelerate learning operations for training data model 164. Combining the data from each modality can provide a more comprehensive dataset that enhances an accuracy or confidence in predictions or inferences generated using the data model 164, than processing sensor data obtained from either of the modalities alone.

Combining the data from two or more modalities also provides expanded context for aiding how the system 100 interprets or processes sensor data 125. For example, using the combined data set, wellness engine 162 is operable to recognize that a person may be holding a coffee cup as they sit down. This and other visual recognitions can provide an analytical context for why a person's weight transfer is less symmetrical or more symmetrical than a usual weight transfer indicated by the person's baseline wellness profile. In some implementations, the wellness engine 162 is operable to compare stride analysis data from floor area sensors (e.g., a third modality), or video sensor data of a user walking, with sensor data 125 about how well the user performs at getting up from a chair. This combined sensor dataset can be analyzed or processed against a baseline user model for the person's age, or other physical traits, to develop a mobility score for assessing the person's overall mobility. This combined sensor dataset can also be analyzed and processed against a baseline user model for the person to determine abnormal conditions that may be affecting the person.

System 100 determines that the abnormal condition is a particular type of abnormal condition that is afflicting the person and a wellness command that triggers a display of instructions for alleviating the particular type of abnormal condition afflicting the person (210). For example, to determine that the abnormal condition is a particular type of abnormal condition, the data model can process sensor data and image/video content corresponding to visual indications obtained after prompting the user to adjust how the user is positioned in the seating apparatus.

In some implementations, the wellness engine 162 uses the data model 164 to generate predictions about the abnormal condition based on a set of inferences that indicate different types of abnormal conditions that may be affecting the person. The inferences can be computed based on iterative analysis parameter and pixel values for sensor data, images, and video content from multiple observations that depict how the user is positioned in the seating apparatus as well as how the person moves relative to the seating apparatus when prompt to adjust their position. In some cases the inferences can be linked to different types of conditions that have a connection to the abnormal condition.

For example, the abnormal condition can be neck pain or back pain and different types of abnormal conditions (e.g., candidate types) can be pinched nerve in the neck area, acute lower back pain, or upper back pain. The data model 164 can determine the particular type of abnormal condition and the wellness command based on the prediction. In some implementations, sets of inferences or individual predictions can be scored or ranked by the data model 164 based on their relevance to, or consistency with, the sensor data, images, and video content, or combinations of each. The wellness engine 162 can select a particular type of condition (e.g., lower back pain) based on the score/rank and generate a prediction based on the selected type of condition.

Based on the wellness command, the system 100 triggers display of the instructions at the client device (212). The system 100 uses the wellness command to trigger display of the instructions at the client device to alleviate the particular type of abnormal condition based on the instructions. For example, based on assessments and observed data indicating the particular type of abnormal condition, the system 100 can provide one or more wellness commands to a client device 140 and trigger display of different types of instructions to guide a user towards corrective exercises to alleviate the particular type of abnormal condition. In addition to providing the wellness commands, the system 100 can monitor physical improvements that indicate the abnormal condition is being alleviated and provide feedback on a user's progress.

In some implementations, a user can be guided through an active assessment phase at the property 102 based at least on instructions (e.g., audio or video) displayed or output at the client device. For example, the monitoring server 160 can generate one or more audio and video based notifications that prompt the user to perform certain tasks, such as turning their head to look to the side while sitting or reaching forward or to the side while sitting. As the user performs these actions, sensors 120 that are integrated in the seating apparatus 114 concurrently process generated sensor signals to assess the user's weight transfer and stability during performance of the actions. In some implementations, actuators are incorporated in the seating apparatus 114 to tilt the seating apparatus 114, while sensors 120 generate sensor signals for assessing the user's ability to counteract the tilt of the seating apparatus 114.

Wellness engine 162 is operable to include an example calibration phase where a user sits in the seating apparatus 114 and performs a guided routine of movements to establish a baseline wellness profile. The user can perform the guided routine based on notifications or prompts that are received at a display of the client device 140. For example, the guided routine of movements can include a user sitting in a chair and raising their feet off the floor area 124 to establish a baseline weight based on a first notification for the calibration. The guided routine of movements can also include a user sitting in different extremes of a particular position to establish how a subset of sensors 120 register the extreme positions, particularly with reference to a system that is retrofitted with a various sensors 120.

In some implementations, the system 100 uses calibration or clustering algorithms and corresponding baseline calibration data to recognize or identity certain individuals when there are multiple users of a single chair 114. In some cases, during an example calibration or assessment phase, the client device 140 can be used to configure various sensors 120 to transmit and receive data communications via the client device or the property monitoring system. The client device 140 can also be used to provide user prompting and feedback of activities associated with an example calibration or assessment process.

Figure 3:
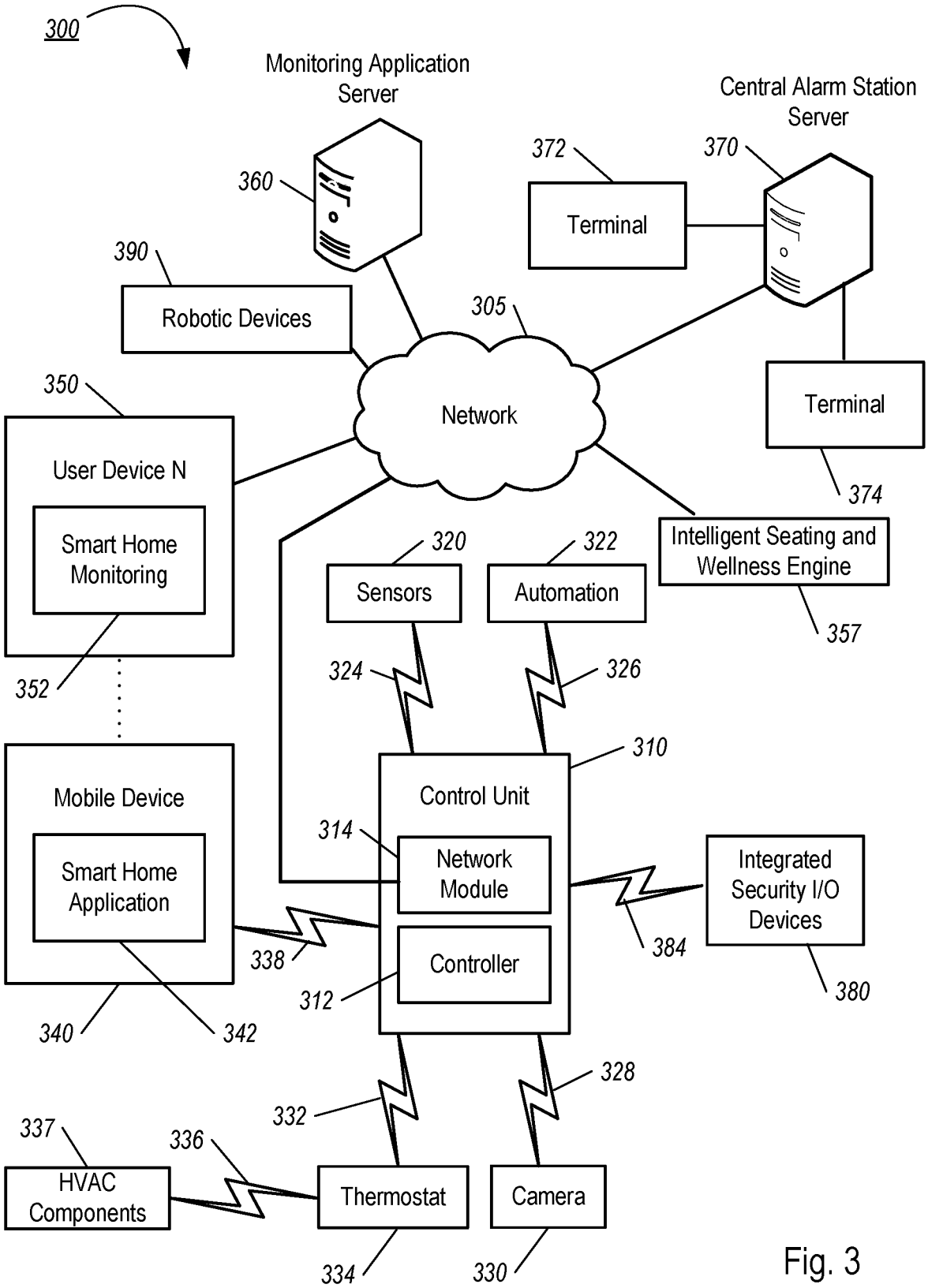
FIG. 3 shows a diagram illustrating an example property monitoring system.

FIG. 3 is a diagram illustrating an example of a property monitoring system 300. The electronic system 300 includes a network 305, a control unit 310, one or more user devices 340 and 350, a monitoring server 360, and a central alarm station server 370. In some examples, the network 305 facilitates communications between the control unit 310, the one or more user devices 340 and 350, the monitoring server 360, and the central alarm station server 370.

The network 305 is configured to enable exchange of electronic communications between devices connected to the network 305. For example, the network 305 may be configured to enable exchange of electronic communications between the control unit 310, the one or more user devices 340 and 350, the monitoring server 360, and the central alarm station server 370. The network 305 may include, for example, one or more of the Internet, Wide Area Networks (WANs), Local Area Networks (LANs), analog or digital wired and wireless telephone networks (e.g., a public switched telephone network (PSTN), Integrated Services Digital Network (ISDN), a cellular network, and Digital Subscriber Line (DSL)), radio, television, cable, satellite, or any other delivery or tunneling mechanism for carrying data.

Network 305 may include multiple networks or subnetworks, each of which may include, for example, a wired or wireless data pathway. The network 305 may include a circuit-switched network, a packet-switched data network, or any other network able to carry electronic communications (e.g., data or voice communications). For example, the network 305 may include networks based on the Internet protocol (IP), asynchronous transfer mode (ATM), the PSTN, packet-switched networks based on IP, X.25, or Frame Relay, or other comparable technologies and may support voice using, for example, VoIP, or other comparable protocols used for voice communications. The network 305 may include one or more networks that include wireless data channels and wireless voice channels. The network 305 may be a wireless network, a broadband network, or a combination of networks including a wireless network and a broadband network.

The control unit 310 includes a controller 312 and a network module 314. The controller 312 is configured to control a control unit monitoring system (e.g., a control unit system) that includes the control unit 310. In some examples, the controller 312 may include a processor or other control circuitry configured to execute instructions of a program that controls operation of a control unit system. In these examples, the controller 312 may be configured to receive input from sensors, flow meters, or other devices included in the control unit system and control operations of devices included in the household (e.g., speakers, lights, doors, etc.). For example, the controller 312 may be configured to control operation of the network module 314 included in the control unit 310.

The network module 314 is a communication device configured to exchange communications over the network 305. The network module 314 may be a wireless communication module configured to exchange wireless communications over the network 305. For example, the network module 314 may be a wireless communication device configured to exchange communications over a wireless data channel and a wireless voice channel. In this example, the network module 314 may transmit alarm data over a wireless data channel and establish a two-way voice communication session over a wireless voice channel. The wireless communication device may include one or more of a LTE module, a GSM module, a radio modem, cellular transmission module, or any type of module configured to exchange communications in one of the following formats: LTE, GSM or GPRS, CDMA, EDGE or EGPRS, EV-DO or EVDO, UMTS, or IP.

The network module 314 also may be a wired communication module configured to exchange communications over the network 305 using a wired connection. For instance, the network module 314 may be a modem, a network interface card, or another type of network interface device. The network module 314 may be an Ethernet network card configured to enable the control unit 310 to communicate over a local area network and/or the Internet. The network module 314 also may be a voice band modem configured to enable the alarm panel to communicate over the telephone lines of Plain Old Telephone Systems (POTS).

The control unit system that includes the control unit 310 includes one or more sensors. For example, the monitoring system may include multiple sensors 320. The sensors 320 may include a lock sensor, a contact sensor, a motion sensor, or any other type of sensor included in a control unit system. The sensors 320 also may include an environmental sensor, such as a temperature sensor, a water sensor, a rain sensor, a wind sensor, a light sensor, a smoke detector, a carbon monoxide detector, an air quality sensor, etc. The sensors 320 further may include a health monitoring sensor, such as a prescription bottle sensor that monitors taking of prescriptions, a blood pressure sensor, a blood sugar sensor, a bed mat configured to sense presence of liquid (e.g., bodily fluids) on the bed mat, etc. In some examples, the health monitoring sensor can be a wearable sensor that attaches to a user in the home. The health monitoring sensor can collect various health data, including pulse, heart-rate, respiration rate, sugar or glucose level, bodily temperature, or motion data.

The sensors 320 can also include a radio-frequency identification (RFID) sensor that identifies a particular article that includes a pre-assigned RFID tag.

The control unit 310 communicates with the home automation controls 322 and a camera 330 to perform monitoring. The home automation controls 322 are connected to one or more devices that enable automation of actions in the home. For instance, the home automation controls 322 may be connected to one or more lighting systems and may be configured to control operation of the one or more lighting systems. Also, the home automation controls 322 may be connected to one or more electronic locks at the home and may be configured to control operation of the one or more electronic locks (e.g., control Z-Wave locks using wireless communications in the Z-Wave protocol). Further, the home automation controls 322 may be connected to one or more appliances at the home and may be configured to control operation of the one or more appliances. The home automation controls 322 may include multiple modules that are each specific to the type of device being controlled in an automated manner. The home automation controls 322 may control the one or more devices based on commands received from the control unit 310. For instance, the home automation controls 322 may cause a lighting system to illuminate an area to provide a better image of the area when captured by a camera 330.

The camera 330 may be a video/photographic camera or other type of optical sensing device configured to capture images. For instance, the camera 330 may be configured to capture images of an area within a building or home monitored by the control unit 310. The camera 330 may be configured to capture single, static images of the area and also video images of the area in which multiple images of the area are captured at a relatively high frequency (e.g., thirty images per second). The camera 330 may be controlled based on commands received from the control unit 310.

The camera 330 may be triggered by several different types of techniques. For instance, a Passive Infra-Red (PIR) motion sensor may be built into the camera 330 and used to trigger the camera 330 to capture one or more images when motion is detected. The camera 330 also may include a microwave motion sensor built into the camera and used to trigger the camera 330 to capture one or more images when motion is detected. The camera 330 may have a "normally open" or "normally closed" digital input that can trigger capture of one or more images when external sensors (e.g., the sensors 320, PIR, door/window, etc.) detect motion or other events. In some implementations, the camera 330 receives a command to capture an image when external devices detect motion or another potential alarm event. The camera 330 may receive the command from the controller 312 or directly from one of the sensors 320.

In some examples, the camera 330 triggers integrated or external illuminators (e.g., Infra-Red, Z-wave controlled "white" lights, lights controlled by the home automation controls 322, etc.) to improve image quality when the scene is dark. An integrated or separate light sensor may be used to determine if illumination is desired and may result in increased image quality.

The camera 330 may be programmed with any combination of time/day schedules, system "arming state", or other variables to determine whether images should be captured or not when triggers occur. The camera 330 may enter a low-power mode when not capturing images. In this case, the camera 330 may wake periodically to check for inbound messages from the controller 312. The camera 330 may be powered by internal, replaceable batteries if located remotely from the control unit 310. The camera 330 may employ a small solar cell to recharge the battery when light is available. Alternatively, the camera 330 may be powered by the controller's 312 power supply if the camera 330 is co-located with the controller 312.

In some implementations, the camera 330 communicates directly with the monitoring server 360 over the Internet. In these implementations, image data captured by the camera 330 does not pass through the control unit 310 and the camera 330 receives commands related to operation from the monitoring server 360.

The system 300 also includes thermostat 334 to perform dynamic environmental control at the home. The thermostat 334 is configured to monitor temperature and/or energy consumption of an HVAC system associated with the thermostat 334, and is further configured to provide control of environmental (e.g., temperature) settings. In some implementations, the thermostat 334 can additionally or alternatively receive data relating to activity at a home and/or environmental data at a home, e.g., at various locations indoors and outdoors at the home. The thermostat 334 can directly measure energy consumption of the HVAC system associated with the thermostat, or can estimate energy consumption of the HVAC system associated with the thermostat 334, for example, based on detected usage of one or more components of the HVAC system associated with the thermostat 334. The thermostat 334 can communicate temperature and/or energy monitoring information to or from the control unit 310 and can control the environmental (e.g., temperature) settings based on commands received from the control unit 310.

In some implementations, the thermostat 334 is a dynamically programmable thermostat and can be integrated with the control unit 310. For example, the dynamically programmable thermostat 334 can include the control unit 310, e.g., as an internal component to the dynamically programmable thermostat 334. In addition, the control unit 310 can be a gateway device that communicates with the dynamically programmable thermostat 334. In some implementations, the thermostat 334 is controlled via one or more home automation controls 322.

A module 337 is connected to one or more components of an HVAC system associated with a home, and is configured to control operation of the one or more components of the HVAC system. In some implementations, the module 337 is also configured to monitor energy consumption of the HVAC system components, for example, by directly measuring the energy consumption of the HVAC system components or by estimating the energy usage of the one or more HVAC system components based on detecting usage of components of the HVAC system. The module 337 can communicate energy monitoring information and the state of the HVAC system components to the thermostat 334 and can control the one or more components of the HVAC system based on commands received from the thermostat 334.

The system 300 includes one or more intelligent seating and wellness engines 357 ("wellness engine 357"). Each of the one or more wellness engine 357 connects to control unit 310, e.g., through network 305. The wellness engines 357 can be computing devices (e.g., a computer, microcontroller, FPGA, ASIC, or other device capable of electronic computation) capable of receiving data related to the sensors 320 and communicating electronically with the monitoring system control unit 310 and monitoring server 360.

The wellness engine 357 receives data from one or more sensors 320. In some examples, the wellness engine 357 can be used to determine or indicate certain user wellness conditions or abnormal conditions based on data generated by sensors 320 (e.g., data from sensor 320 describing sensed weight transfer or weight distribution, stride data, or image data. The wellness engine 357 can receive data from the one or more sensors 320 through any combination of wired and/or wireless data links. For example, the wellness engine 357 can receive sensor data via a Bluetooth, Bluetooth LE, Z-wave, or Zigbee data link.

The wellness engine 357 communicates electronically with the control unit 310. For example, the wellness engine 357 can send data related to the sensors 320 to the control unit 310 and receive commands related to determining seating positions and calibration activity based on data from the sensors 320. In some examples, the wellness engine 357 processes or generates sensor signal data, for signals emitted by the sensors 320, prior to sending it to the control unit 310. The sensor signal data can include wellness data that indicates a particular type of abnormal condition that is affecting a person at the property 102.

In some examples, the system 300 further includes one or more robotic devices 390. The robotic devices 390 may be any type of robots that are capable of moving and taking actions that assist in home monitoring. For example, the robotic devices 390 may include drones that are capable of moving throughout a home based on automated control technology and/or user input control provided by a user. In this example, the drones may be able to fly, roll, walk, or otherwise move about the home. The drones may include helicopter type devices (e.g., quad copters), rolling helicopter type devices (e.g., roller copter devices that can fly and also roll along the ground, walls, or ceiling) and land vehicle type devices (e.g., automated cars that drive around a home). In some cases, the robotic devices 390 may be devices that are intended for other purposes and merely associated with the system 300 for use in appropriate circumstances. For instance, a robotic vacuum cleaner device may be associated with the monitoring system 300 as one of the robotic devices 390 and may be controlled to take action responsive to monitoring system events.

In some examples, the robotic devices 390 automatically navigate within a home. In these examples, the robotic devices 390 include sensors and control processors that guide movement of the robotic devices 390 within the home. For instance, the robotic devices 390 may navigate within the home using one or more cameras, one or more proximity sensors, one or more gyroscopes, one or more accelerometers, one or more magnetometers, a global positioning system (GPS) unit, an altimeter, one or more sonar or laser sensors, and/or any other types of sensors that aid in navigation about a space. The robotic devices 390 may include control processors that process output from the various sensors and control the robotic devices 390 to move along a path that reaches the desired destination and avoids obstacles. In this regard, the control processors detect walls or other obstacles in the home and guide movement of the robotic devices 390 in a manner that avoids the walls and other obstacles.

In addition, the robotic devices 390 may store data that describes attributes of the home. For instance, the robotic devices 390 may store a floorplan and/or a three-dimensional model of the home that enables the robotic devices 390 to navigate the home. During initial configuration, the robotic devices 390 may receive the data describing attributes of the home, determine a frame of reference to the data (e.g., a home or reference location in the home), and navigate the home based on the frame of reference and the data describing attributes of the home. Further, initial configuration of the robotic devices 390 also may include learning of one or more navigation patterns in which a user provides input to control the robotic devices 390 to perform a specific navigation action (e.g., fly to an upstairs bedroom and spin around while capturing video and then return to a home charging base). In this regard, the robotic devices 390 may learn and store the navigation patterns such that the robotic devices 390 may automatically repeat the specific navigation actions upon a later request.

In some examples, the robotic devices 390 may include data capture and recording devices. In these examples, the robotic devices 390 may include one or more cameras, one or more motion sensors, one or more microphones, one or more biometric data collection tools, one or more temperature sensors, one or more humidity sensors, one or more air flow sensors, and/or any other types of sensors that may be useful in capturing monitoring data related to the home and users in the home. The one or more biometric data collection tools may be configured to collect biometric samples of a person in the home with or without contact of the person. For instance, the biometric data collection tools may include a fingerprint scanner, a hair sample collection tool, a skin cell collection tool, and/or any other tool that allows the robotic devices 390 to take and store a biometric sample that can be used to identify the person (e.g., a biometric sample with DNA that can be used for DNA testing).

In some implementations, the robotic devices 390 may include output devices. In these implementations, the robotic devices 390 may include one or more displays, one or more speakers, and/or any type of output devices that allow the robotic devices 390 to communicate information to a nearby user.

The robotic devices 390 also may include a communication module that enables the robotic devices 390 to communicate with the control unit 310, each other, and/or other devices. The communication module may be a wireless communication module that allows the robotic devices 390 to communicate wirelessly. For instance, the communication module may be a Wi-Fi module that enables the robotic devices 390 to communicate over a local wireless network at the home. The communication module further may be a 900 MHz wireless communication module that enables the robotic devices 390 to communicate directly with the control unit 310. Other types of short-range wireless communication protocols, such as Bluetooth, Bluetooth LE, Z-wave, Zigbee, etc., may be used to allow the robotic devices 390 to communicate with other devices in the home. In some implementations, the robotic devices 390 may communicate with each other or with other devices of the system 300 through the network 305.

The robotic devices 390 further may include processor and storage capabilities. The robotic devices 390 may include any suitable processing devices that enable the robotic devices 390 to operate applications and perform the actions described throughout this disclosure. In addition, the robotic devices 390 may include solid state electronic storage that enables the robotic devices 390 to store applications, configuration data, collected sensor data, and/or any other type of information available to the robotic devices 390.

The robotic devices 390 are associated with one or more charging stations. The charging stations may be located at predefined home base or reference locations in the home. The robotic devices 390 may be configured to navigate to the charging stations after completion of tasks needed to be performed for the monitoring system 300. For instance, after completion of a monitoring operation or upon instruction by the control unit 310, the robotic devices 390 may be configured to automatically fly to and land on one of the charging stations. In this regard, the robotic devices 390 may automatically maintain a fully charged battery in a state in which the robotic devices 390 are ready for use by the monitoring system 300.

The charging stations may be contact based charging stations and/or wireless charging stations. For contact based charging stations, the robotic devices 390 may have readily accessible points of contact that the robotic devices 390 are capable of positioning and mating with a corresponding contact on the charging station. For instance, a helicopter type robotic device may have an electronic contact on a portion of its landing gear that rests on and mates with an electronic pad of a charging station when the helicopter type robotic device lands on the charging station. The electronic contact on the robotic device may include a cover that opens to expose the electronic contact when the robotic device is charging and closes to cover and insulate the electronic contact when the robotic device is in operation.

For wireless charging stations, the robotic devices 390 may charge through a wireless exchange of power. In these cases, the robotic devices 390 need only locate themselves closely enough to the wireless charging stations for the wireless exchange of power to occur. In this regard, the positioning needed to land at a predefined home base or reference location in the home may be less precise than with a contact based charging station. Based on the robotic devices 390 landing at a wireless charging station, the wireless charging station outputs a wireless signal that the robotic devices 390 receive and convert to a power signal that charges a battery maintained on the robotic devices 390.

In some implementations, each of the robotic devices 390 has a corresponding and assigned charging station such that the number of robotic devices 390 equals the number of charging stations. In these implementations, the robotic devices 390 always navigate to the specific charging station assigned to that robotic device. For instance, a first robotic device may always use a first charging station and a second robotic device may always use a second charging station.

In some examples, the robotic devices 390 may share charging stations. For instance, the robotic devices 390 may use one or more community charging stations that are capable of charging multiple robotic devices 390. The community charging station may be configured to charge multiple robotic devices 390 in parallel. The community charging station may be configured to charge multiple robotic devices 390 in serial such that the multiple robotic devices 390 take turns charging and, when fully charged, return to a predefined home base or reference location in the home that is not associated with a charger. The number of community charging stations may be less than the number of robotic devices 390.

Also, the charging stations may not be assigned to specific robotic devices 390 and may be capable of charging any of the robotic devices 390. In this regard, the robotic devices 390 may use any suitable, unoccupied charging station when not in use. For instance, when one of the robotic devices 390 has completed an operation or is in need of battery charge, the control unit 310 references a stored table of the occupancy status of each charging station and instructs the robotic device to navigate to the nearest charging station that is unoccupied.

The system 300 further includes one or more integrated security devices 380. The one or more integrated security devices may include any type of device used to provide alerts based on received sensor data. For instance, the one or more control units 310 may provide one or more alerts to the one or more integrated security input/output devices 380.

Additionally, the one or more control units 310 may receive one or more sensor data from the sensors 320 and determine whether to provide an alert to the one or more integrated security input/output devices 380.

The sensors 320, the home automation controls 322, the camera 330, the thermostat 334, and the integrated security devices 380 may communicate with the controller 312 over communication links 324, 326, 328, 332, 338, and 384. The communication links 324, 326, 328, 332, 338, and 384 may be a wired or wireless data pathway configured to transmit signals from the sensors 320, the home automation controls 322, the camera 330, the thermostat 334, and the integrated security devices 380 to the controller 312. The sensors 320, the home automation controls 322, the camera 330, the thermostat 334, and the integrated security devices 380 may continuously transmit sensed values to the controller 312, periodically transmit sensed values to the controller 312, or transmit sensed values to the controller 312 in response to a change in a sensed value.

The communication links 324, 326, 328, 332, 338, and 384 may include a local network. The sensors 320, the home automation controls 322, the camera 330, the thermostat 334, and the integrated security devices 380, and the controller 312 may exchange data and commands over the local network. The local network may include 802.11 "Wi-Fi" wireless Ethernet (e.g., using low-power Wi-Fi chipsets), Z-Wave, Zigbee, Bluetooth, "Homeplug" or other "Powerline" networks that operate over AC wiring, and a Category 5 (CAT5) or Category 6 (CAT6) wired Ethernet network. The local network may be a mesh network constructed based on the devices connected to the mesh network.

The monitoring server 360 is an electronic device configured to provide monitoring services by exchanging electronic communications with the control unit 310, the one or more user devices 340 and 350, and the central alarm station server 370 over the network 305. For example, the monitoring server 360 may be configured to monitor events (e.g., alarm events) generated by the control unit 310. In this example, the monitoring server 360 may exchange electronic communications with the network module 314 included in the control unit 310 to receive information regarding events (e.g., alerts) detected by the control unit 310. The monitoring server 360 also may receive information regarding events (e.g., alerts) from the one or more user devices 340 and 350.

In some examples, the monitoring server 360 may route alert data received from the network module 314 or the one or more user devices 340 and 350 to the central alarm station server 370. For example, the monitoring server 360 may transmit the alert data to the central alarm station server 370 over the network 305.

The monitoring server 360 may store sensor and image data received from the monitoring system and perform analysis of sensor and image data received from the monitoring system. Based on the analysis, the monitoring server 360 may communicate with and control aspects of the control unit 310 or the one or more user devices 340 and 350.

The monitoring server 360 may provide various monitoring services to the system 300. For example, the monitoring server 360 may analyze the sensor, image, and other data to determine an activity pattern of a resident of the home monitored by the system 300. In some implementations, the monitoring server 360 may analyze the data for alarm conditions or may determine and perform actions at the home by issuing commands to one or more of the controls 322, possibly through the control unit 310.

The central alarm station server 370 is an electronic device configured to provide alarm monitoring service by exchanging communications with the control unit 310, the one or more mobile devices 340 and 350, and the monitoring server 360 over the network 305. For example, the central alarm station server 370 may be configured to monitor alerting events generated by the control unit 310. In this example, the central alarm station server 370 may exchange communications with the network module 314 included in the control unit 310 to receive information regarding alerting events detected by the control unit 310. The central alarm station server 370 also may receive information regarding alerting events from the one or more mobile devices 340 and 350 and/or the monitoring server 360.

The central alarm station server 370 is connected to multiple terminals 372 and 374. The terminals 372 and 374 may be used by operators to process alerting events. For example, the central alarm station server 370 may route alerting data to the terminals 372 and 374 to enable an operator to process the alerting data. The terminals 372 and 374 may include general-purpose computers (e.g., desktop personal computers, workstations, or laptop computers) that are configured to receive alerting data from a server in the central alarm station server 370 and render a display of information based on the alerting data. For instance, the controller 312 may control the network module 314 to transmit, to the central alarm station server 370, alerting data indicating that a sensor 320 detected motion from a motion sensor via the sensors 320. The central alarm station server 370 may receive the alerting data and route the alerting data to the terminal 372 for processing by an operator associated with the terminal 372. The terminal 372 may render a display to the operator that includes information associated with the alerting event (e.g., the lock sensor data, the motion sensor data, the contact sensor data, etc.) and the operator may handle the alerting event based on the displayed information.

In some implementations, the terminals 372 and 374 may be mobile devices or devices designed for a specific function. Although FIG. 3 illustrates two terminals for brevity, actual implementations may include more (and, perhaps, many more) terminals.

The one or more authorized user devices 340 and 350 are devices that host and display user interfaces. For instance, the user device 340 is a mobile device that hosts or runs one or more native applications (e.g., the smart home application 342). The user device 340 may be a cellular phone or a non-cellular locally networked device with a display. The user device 340 may include a cell phone, a smart phone, a tablet PC, a personal digital assistant ("PDA"), or any other portable device configured to communicate over a network and display information. For example, implementations may also include Blackberry-type devices (e.g., as provided by Research in Motion), electronic organizers, iPhone-type devices (e.g., as provided by Apple), iPod devices (e.g., as provided by Apple) or other portable music players, other communication devices, and handheld or portable electronic devices for gaming, communications, and/or data organization. The user device 340 may perform functions unrelated to the monitoring system, such as placing personal telephone calls, playing music, playing video, displaying pictures, browsing the Internet, maintaining an electronic calendar, etc.

The user device 340 includes a smart home application 342. The smart home application 342 refers to a software/firmware program running on the corresponding mobile device that enables the user interface and features described throughout. The user device 340 may load or install the smart home application 342 based on data received over a network or data received from local media. The smart home application 342 runs on mobile devices platforms, such as iPhone, iPod touch, Blackberry, Google Android, Windows Mobile, etc. The smart home application 342 enables the user device 340 to receive and process image and sensor data from the monitoring system.

The user device 350 may be a general-purpose computer (e.g., a desktop personal computer, a workstation, or a laptop computer) that is configured to communicate with the monitoring server 360 and/or the control unit 310 over the network 305. The user device 350 may be configured to display a smart home user interface 352 that is generated by the user device 350 or generated by the monitoring server 360. For example, the user device 350 may be configured to display a user interface (e.g., a web page) provided by the monitoring server 360 that enables a user to perceive images captured by the camera 330 and/or reports related to the monitoring system. Although FIG. 3 illustrates two user devices for brevity, actual implementations may include more (and, perhaps, many more) or fewer user devices.

In some implementations, the one or more user devices 340 and 350 communicate with and receive monitoring system data from the control unit 310 using the communication link 338. For instance, the one or more user devices 340 and 350 may communicate with the control unit 310 using various local wireless protocols such as Wi-Fi, Bluetooth, Z-wave, Zigbee, HomePlug (ethernet over power line), or wired protocols such as Ethernet and USB, to connect the one or more user devices 340 and 350 to local security and automation equipment. The one or more user devices 340 and 350 may connect locally to the monitoring system and its sensors and other devices. The local connection may improve the speed of status and control communications because communicating through the network 305 with a remote server (e.g., the monitoring server 360) may be significantly slower.

Although the one or more user devices 340 and 350 are shown as communicating with the control unit 310, the one or more user devices 340 and 350 may communicate directly with the sensors and other devices controlled by the control unit 310. In some implementations, the one or more user devices 340 and 350 replace the control unit 310 and perform the functions of the control unit 310 for local monitoring and long range/offsite communication.

In other implementations, the one or more user devices 340 and 350 receive monitoring system data captured by the control unit 310 through the network 305. The one or more user devices 340, 350 may receive the data from the control unit 310 through the network 305 or the monitoring server 360 may relay data received from the control unit 310 to the one or more user devices 340 and 350 through the network 305. In this regard, the monitoring server 360 may facilitate communication between the one or more user devices 340 and 350 and the monitoring system.

In some implementations, the one or more user devices 340 and 350 may be configured to switch whether the one or more user devices 340 and 350 communicate with the control unit 310 directly (e.g., through link 338) or through the monitoring server 360 (e.g., through network 305) based on a location of the one or more user devices 340 and 350. For instance, when the one or more user devices 340 and 350 are located close to the control unit 310 and in range to communicate directly with the control unit 310, the one or more user devices 340 and 350 use direct communication. When the one or more user devices 340 and 350 are located far from the control unit 310 and not in range to communicate directly with the control unit 310, the one or more user devices 340 and 350 use communication through the monitoring server 360.

Although the one or more user devices 340 and 350 are shown as being connected to the network 305, in some implementations, the one or more user devices 340 and 350 are not connected to the network 305. In these implementations, the one or more user devices 340 and 350 communicate directly with one or more of the monitoring system components and no network (e.g., Internet) connection or reliance on remote servers is needed.

In some implementations, the one or more user devices 340 and 350 are used in conjunction with only local sensors and/or local devices in a house. In these implementations, the system 300 includes the one or more user devices 340 and 350, the sensors 320, the home automation controls 322, the camera 330, the robotic devices 390, and the wellness engine 357. The one or more user devices 340 and 350 receive data directly from the sensors 320, the home automation controls 322, the camera 330, the robotic devices 390, and the wellness engine 357 and sends data directly to the sensors 320, the home automation controls 322, the camera 330, the robotic devices 390, and the wellness engine 357. The one or more user devices 340, 350 provide the appropriate interfaces/processing to provide visual surveillance and reporting.

In other implementations, the system 300 further includes network 305 and the sensors 320, the home automation controls 322, the camera 330, the thermostat 334, the robotic devices 390, and the wellness engine 357 are configured to communicate sensor and image data to the one or more user devices 340 and 350 over network 305 (e.g., the Internet, cellular network, etc.). In yet another implementation, the sensors 320, the home automation controls 322, the camera 330, the thermostat 334, the robotic devices 390, and the wellness engine 357 (or a component, such as a bridge/router) are intelligent enough to change the communication pathway from a direct local pathway when the one or more user devices 340 and 350 are in close physical proximity to the sensors 320, the home automation controls 322, the camera 330, the thermostat 334, the robotic devices 390, and the wellness engine 357 to a pathway over network 305 when the one or more user devices 340 and 350 are farther from the sensors 320, the home automation controls 322, the camera 330, the thermostat 334, the robotic devices 390, and the wellness engine.

In some examples, the system leverages GPS information from the one or more user devices 340 and 350 to determine whether the one or more user devices 340 and 350 are close enough to the sensors 320, the home automation controls 322, the camera 330, the thermostat 334, the robotic devices 390, and the wellness engine 357 to use the direct local pathway or whether the one or more user devices 340 and 350 are far enough from the sensors 320, the home automation controls 322, the camera 330, the thermostat 334, the robotic devices 390, and the wellness engine 357 that the pathway over network 305 is required.

In other examples, the system leverages status communications (e.g., pinging) between the one or more user devices 340 and 350 and the sensors 320, the home automation controls 322, the camera 330, the thermostat 334, the robotic devices 390, and the wellness engine 357 to determine whether communication using the direct local pathway is possible. If communication using the direct local pathway is possible, the one or more user devices 340 and 350 communicate with the sensors 320, the home automation controls 322, the camera 330, the thermostat 334, the robotic devices 390, and the wellness engine 357 using the direct local pathway. If communication using the direct local pathway is not possible, the one or more user devices 340 and 350 communicate with the sensors 320, the home automation controls 322, the camera 330, the thermostat 334, the robotic devices 390, and the wellness engine 357 using the pathway over network 305.

In some implementations, the system 300 provides end users with access to images captured by the camera 330 to aid in decision making. The system 300 may transmit the images captured by the camera 330 over a wireless WAN network to the user devices 340 and 350. Because transmission over a wireless WAN network may be relatively expensive, the system 300 can use several techniques to reduce costs while providing access to significant levels of useful visual information (e.g., compressing data, down-sampling data, sending data only over inexpensive LAN connections, or other techniques).

In some implementations, a state of the monitoring system and other events sensed by the monitoring system may be used to enable/disable video/image recording devices (e.g., the camera 330). In these implementations, the camera 330 may be set to capture images on a periodic basis when the alarm system is armed in an "away" state, but set not to capture images when the alarm system is armed in a "home" state or disarmed. In addition, the camera 330 may be triggered to begin capturing images when the alarm system detects an event, such as an alarm event, a door-opening event for a door that leads to an area within a field of view of the camera 330, or motion in the area within the field of view of the camera 330. In other implementations, the camera 330 may capture images continuously, but the captured images may be stored or transmitted over a network when needed.

The described systems, methods, and techniques may be implemented in digital electronic circuitry, computer hardware, firmware, software, or in combinations of these elements. Apparatus implementing these techniques may include appropriate input and output devices, a computer processor, and a computer program product tangibly embodied in a machine-readable storage device for execution by a programmable processor. A process implementing these techniques may be performed by a programmable processor executing a program of instructions to perform desired functions by operating on input data and generating appropriate output. The techniques may be implemented in one or more computer programs that are executable on a programmable system including at least one programmable processor coupled to receive data and instructions from, and to transmit data and instructions to, a data storage system, at least one input device, and at least one output device.

Each computer program may be implemented in a high-level procedural or object-oriented programming language, or in assembly or machine language if desired; and in any case, the language may be a compiled or interpreted language. Suitable processors include, by way of example, both general and special purpose microprocessors. Generally, a processor will receive instructions and data from a read-only memory and/or a random access memory. Storage devices suitable for tangibly embodying computer program instructions and data include all forms of non-volatile memory, including by way of example semiconductor memory devices, such as Erasable Programmable Read-Only Memory (EPROM), Electrically Erasable Programmable Read-Only Memory (EEPROM), and flash memory devices; magnetic disks such as internal hard disks and removable disks; magneto-optical disks; and Compact Disc Read-Only Memory (CD-ROM). Any of the foregoing may be supplemented by, or incorporated in, specially designed ASICs (application-specific integrated circuits).

It will be understood that various modifications may be made. For example, other useful implementations could be achieved if steps of the disclosed techniques were performed in a different order and/or if components in the disclosed systems were combined in a different manner and/or replaced or supplemented by other components. Accordingly, other implementations are within the scope of the disclosure.

What is claimed is:

1. A computer-implemented method, comprising:

determining that a person has an abnormal condition based on data generated by a sensor integrated in a seating apparatus used by the person;

detecting, based on a visual indication of the person, an adjustment of a position of the person relative to the seating apparatus;

evaluating an impact of the abnormal condition on the person based on the detected adjustment of the person's position relative to the seating apparatus;

generating, based on evaluation of the impact, a wellness command to alleviate the impact of the abnormal condition on the person; and based on the wellness command, presenting, at a client device used by the person, instructions for alleviating the impact of the abnormal condition on the person.

2. The method of claim 1, wherein determining that the person has the abnormal condition comprises:

detecting a weight distribution of the person when the person uses the seating apparatus, the weight distribution being determined using sensor data obtained from a plurality of sensors integrated in the seating apparatus; and determining that the person has the abnormal condition based on the detected weight distribution of the person when the person uses the seating apparatus.

3. The method of claim 2, wherein determining that the person has the abnormal condition comprises:

identifying the person based on sensor data obtained from the sensor or the visual indication obtained from a recording device;

detecting a particular type of movement of the person when the person uses the seating apparatus; and determining that the person has the abnormal condition based on a particular type of movement when the person uses the seating apparatus.

4. The method of claim 3, wherein identifying the person comprises:

obtaining sensor data from the sensor that indicates a weight of the person when the sensor is disposed adjacent one or more legs of the seating apparatus;

computing a weight distribution for the person using the sensor data that indicates the weight of the person; and identifying the person based on the computed weight distribution for the person.

5. The method of claim 1, further comprising:

generating a data model based on machine-learning analysis of:

i) the data obtained from the sensor; and ii) image and video data corresponding to the visual indication obtained from a recording device.

6. The method of claim 5, wherein generating the data model comprises:

generating the data model based on machine-learning analysis of:

i) sensor data obtained from a plurality of sensors integrated in the seating apparatus, wherein the sensor data indicates weight transfers and pressure points that occur in response to the person having used the seating apparatus; and ii) image and video data that indicates a walking stride of the person.

7. The method of claim 6, wherein determining that the abnormal condition is a particular type of abnormal condition comprises:

processing, by the data model, sensor data and image content corresponding to visual indications obtained after prompting a user to adjust how the user is positioned in the seating apparatus;

generating a prediction about the abnormal condition based on a plurality of inferences computed from iterative analysis of multiple observations depicting how the user is positioned in the seating apparatus; and determining the particular type of abnormal condition and the wellness command based on the prediction.

8. The method of claim 6, further comprising:

determining a particular type of abnormal condition based on at least one of: inferences computed using the data model; or probability predications computed using the data model.

9. The method of claim 1, wherein:

obtaining the visual indication comprises providing a command to an image sensor integrated in a recording device to cause the recording device to obtain video data that shows movement patterns of the person; and the command is provided in response to determining that the person has the abnormal condition.

10. The method of claim 1, wherein determining that the person has an abnormal condition comprises:

generating a baseline wellness profile for the person based on multiple observations of the person using the seating apparatus over a predefined duration of time;

detecting a deviation from an expected parameter value indicated in the baseline wellness profile; and determining that the person has the abnormal condition utilizing the detected deviation.

11. The method of claim 1, further comprising:

determining a grade of severity of a particular type of abnormal condition based on a plurality of scores that represent different user conditions associated with the abnormal condition;

determining, based on the grade of severity, a remediation and a corresponding set of instructions for a user to reduce the severity of the particular type of abnormal condition; and providing, for display at the client device, the set of instructions corresponding to the remediation.

12. A system comprising:

one or more processing devices; and one or more non-transitory machine-readable storage devices storing instructions that are executable by the one or more processing devices to cause performance of operations comprising:

determining that a person has an abnormal condition based on data generated by a sensor integrated in a seating apparatus used by the person;

detecting, based on a visual indication of the person, an adjustment of a position of the person relative to the seating apparatus;

evaluating an impact of the abnormal condition on the person based on the detected adjustment of the person's position relative to the seating apparatus;

generating, based on evaluation of the impact, a wellness command to alleviate the impact of the abnormal condition on the person; and based on the wellness command, presenting, at a client device used by the person, instructions for alleviating the impact of the abnormal condition on the person.

13. The system of claim 12, wherein determining that the person has the abnormal condition comprises:

detecting a weight distribution of the person when the person uses the seating apparatus, the weight distribution being determined using sensor data obtained from a plurality of sensors integrated in the seating apparatus; and determining that the person has the abnormal condition based on the detected weight distribution of the person when the person uses the seating apparatus.

14. The system of claim 13, wherein determining that the person has the abnormal condition comprises:

identifying the person based on sensor data obtained from the sensor or the visual indication obtained from a recording device;

detecting a particular type of movement of the person when the person uses the seating apparatus; and determining that the person has the abnormal condition based on a particular type of movement when the person uses the seating apparatus.

15. The system of claim 14, wherein identifying the person comprises:

obtaining sensor data from the sensor that indicates a weight of the person when the sensor is disposed adjacent one or more legs of the seating apparatus;

computing a weight distribution for the person using the sensor data that indicates the weight of the person; and identifying the person based on the computed weight distribution for the person.

16. The system of claim 12, wherein the operations further comprise:

generating a data model based on machine-learning analysis of:

i) the data obtained from the sensor; and ii) image and video data corresponding to the visual indication obtained from a recording device.

17. The system of claim 16, wherein generating the data model comprises:

generating the data model based on machine-learning analysis of:

i) sensor data obtained from a plurality of sensors integrated in the seating apparatus, wherein the sensor data indicates weight transfers and pressure points that occur in response to the person having used the seating apparatus; and ii) image and video data that indicates a walking stride of the person.

18. The system of claim 17, wherein determining that the abnormal condition is a particular type of abnormal condition comprises:

processing, by the data model, sensor data and image content corresponding to visual indications obtained after prompting a user to adjust how the user is positioned in the seating apparatus;

generating a prediction about the abnormal condition based on a plurality of inferences computed from iterative analysis of multiple observations depicting how the user is positioned in the seating apparatus; and determining a particular type of abnormal condition and the wellness command based on the prediction.

19. One or more non-transitory machine-readable storage devices storing instructions that are executable by one or more processing devices to cause performance of operations comprising:

determining that a person has an abnormal condition based on data generated by a sensor integrated in a seating apparatus used by the person;

detecting, based on a visual indication of the person, an adjustment of a position of the person relative to the seating apparatus;

evaluating an impact of the abnormal condition on the person based on the detected adjustment of the person's position relative to the seating apparatus;

generating, based on evaluation of the impact, a wellness command to alleviate the impact of the abnormal condition on the person; and based on the wellness command, presenting, at a client device used by the person, instructions for alleviating the impact of the abnormal condition on the person.

20. The one or more non-transitory machine-readable storage devices of claim 19, the operation comprising:

detecting a weight distribution of the person when the person uses the seating apparatus, the weight distribution being determined using sensor data obtained from a plurality of sensors integrated in the seating apparatus; and determining that the person has the abnormal condition based on the detected weight distribution of the person when the person uses the seating apparatus.

* * * * *